US005829720A

United States Patent [19]

Shiao

[11] Patent Number: 5,829,720

[45] Date of Patent: Nov. 3, 1998

[54] SUPPORTING DEVICE FOR A GOLF BAG STAND

[76] Inventor: Kun-lin Shiao, No. 14, Shih 1st Rd., Youth Ind. Park, Yangmei Chen, Taoyuan Hsien, Taiwan

[21] Appl. No.: 786,437

[22] Filed: Jan. 21, 1997

[51] Int. Cl.[6] ..... A63B 55/00

[52] U.S. Cl. ..... 248/96; 206/315.7

[58] Field of Search ..... 248/96, 97, 155.2, 248/188.9, 346.01, 315, 169; 206/315.7

[56] References Cited

U.S. PATENT DOCUMENTS

| | | | |
|---|---|---|---|
| 4,824,063 | 4/1989 | Miller | 248/346.01 |
| 5,209,350 | 5/1993 | Maeng | 248/96 |
| 5,415,285 | 5/1995 | Reimers | 248/96 |
| 5,464,180 | 11/1995 | Cheng | 248/96 |
| 5,597,144 | 1/1997 | Lee | 248/96 |
| 5,673,879 | 10/1997 | Hsieh | 248/96 |

*Primary Examiner*—Ramon O. Ramirez
*Assistant Examiner*—Willie Berry, Jr.
*Attorney, Agent, or Firm*—William E. Pelton, Esq

[57] ABSTRACT

A supporting device for a golf bag stand includes a supporting plate, a tubular receiver integrally formed with the supporting plate and a bottom plate having a concavity defined therein. The concavity is sized and configured to mate with the struting plate, such that the struting plate is able to be snugly received within the concave space. Furthermore, a first channel is defined within the struting plate and a second channel is defined within the bottom plate, such that when the supporting plate is received within the concavity of the bottom plate, a pin is able to pivotally combine the bottom plate and the supporting plate through the second channel and the first channel respectively, which provides the golf bag an ability to adjust to any terrain when the golf bag is held in a substantially upright position.

7 Claims, 4 Drawing Sheets

SUPPORTING DEVICE FOR A GOLF BAG STAND

FIELD OF THE INVENTION

The present invention generally relates to a supporting device, and more particularly to a supporting device for a golf bag stand, which provides non-slip support to a bottom face of the golf bag when the bag is put on rough terrain.

BACKGROUND OF THE INVENTION

As golf becomes more and more popular around the world, people start to notice the existence and importance of a golf bag which originally only was a bag made of cloth or some soft material. The golf bag is constructed to have an upper frame having a plurality of first holes defined therein, a lower frame and a plurality of rigid struts connected therebetween, so that the bag will not collapse between the upper frame and the lower frame. A conventional golf bag is further constructed to have a pair of first supports pivotally connected to an outer periphery of the bag and a second support disposed between the pair of first supports and rigidly attached to the outer periphery of the bag, so that the golf bag is able to stand substantially upright on a rough terrain when the pair of first supports are extended outward and form a triangle with the second support, as seen in FIG. 1, therefore, the golf bag will be able to stay in a substantially upright position even if the terrain is muddy or sandy.

Although the golf bag as above mentioned is provided with a pair of first supports and a second support to form a triangle to maintain the golf bag in position, a bottom face of the golf bag will still become dirty when in use, and sometimes, the bottom face of the golf bag will slide over in one direction due to the characteristic of the terrain. To improve the situation, some manufacturers further provide a heavy wire to surround a rim of the bottom face of the golf bag, or a plain plate mounted adjacent to the rim of the bottom face and on a distal end of the second support to try to increase the surface of contact between the golf bag and the ground and keep the golf bag clean and rigid. Nevertheless, a heavy wire or a plain plate will still not fulfill the requirements of the user, because using a heavy wire to surround the rim of the bottom face of the golf bag can not provide enough contact surface to the bag, and using a plain plate to mount on the bottom face of the bag still will cause the bag to slide when it is disposed on a wet or a sandy terrain.

From the previous description, it is noted that golf bags sold in the market can not satisfactorily meet the requirements of most golfers. Thus, a golf bag having a supporting device mounted thereon and constructed in accordance with the present invention tends to mitigate and/or obviate the aforementioned problems.

SUMMARY OF THE INVENTION

The main objective of the invention is to provide a supporting device for a golf bag stand. According to one aspect of the invention, the supporting device includes a supporting plate and a bottom plate pivotally receiving the supporting plate therein. The supporting plate is constructed to have a plate and a tubular receiver extending upward from the plate. The bottom plate is configured to have a concavity sized to mate with the plate of the supporting plate.

It is another object of the invention to provide a supporting device for a golf bag stand. The supporting device is provided with a plurality of bosses formed integrally on a face of the bottom plate, such that the bosses can enhance friction between the bottom plate and the ground and therefore provide enough supporting force to the golf bag stand to to keep the bag in an upright position.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
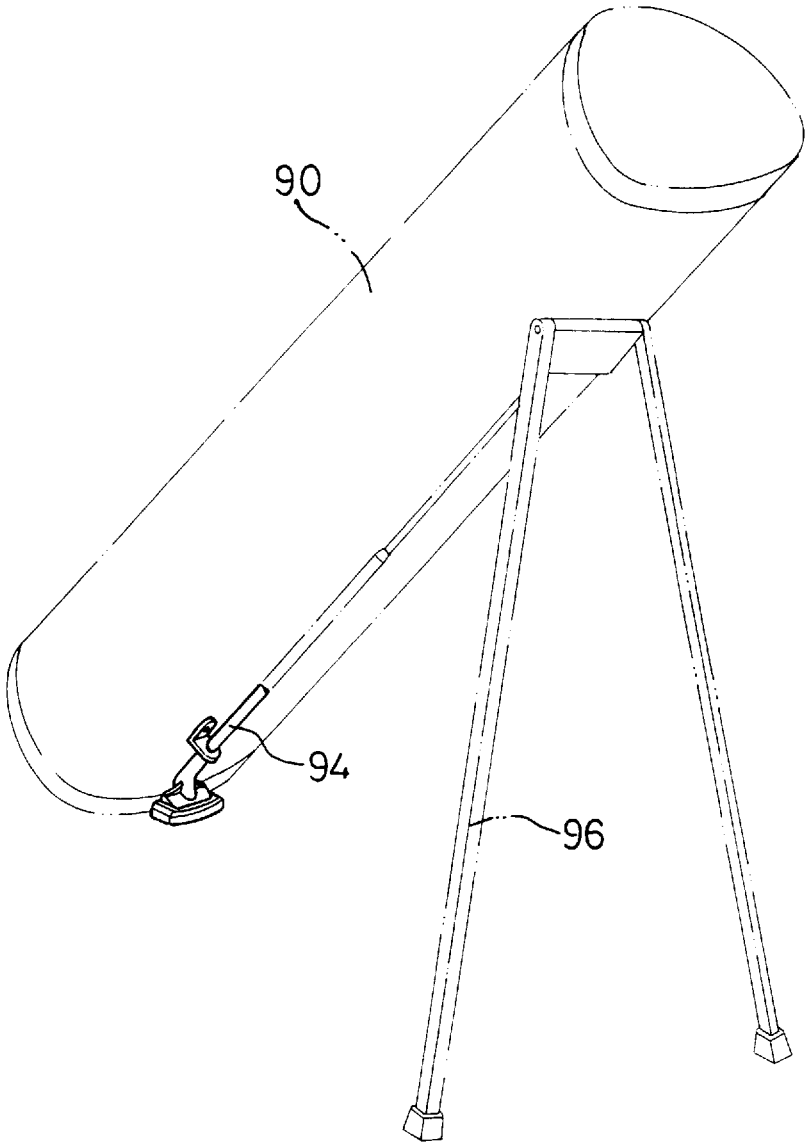
FIG. 1 is a perspective view of a supporting device constructed in accordance with the present invention and combined with a golf bag provided with a pair of supports rods.

Referring to FIG. 1, a supporting device constructed in accordance with the present invention is shown. The supporting device of the invention is mounted together with a golf bag 90 which is provided with a pair of first supports 96 pivotally connected to a side face of the bag 90 and a second support 94 rigidly attached to the side face of the bag 90, whereby the first supports 96 and the second support 96 form a triangular formation, when the pair of first supports 96 extends and separates from each other. It is noted that the supporting device of the invention is mounted on a distal end of the second support 94 and adjacent to a rim (not numbered) of a bottom face of the bag 90.

Figure 2:
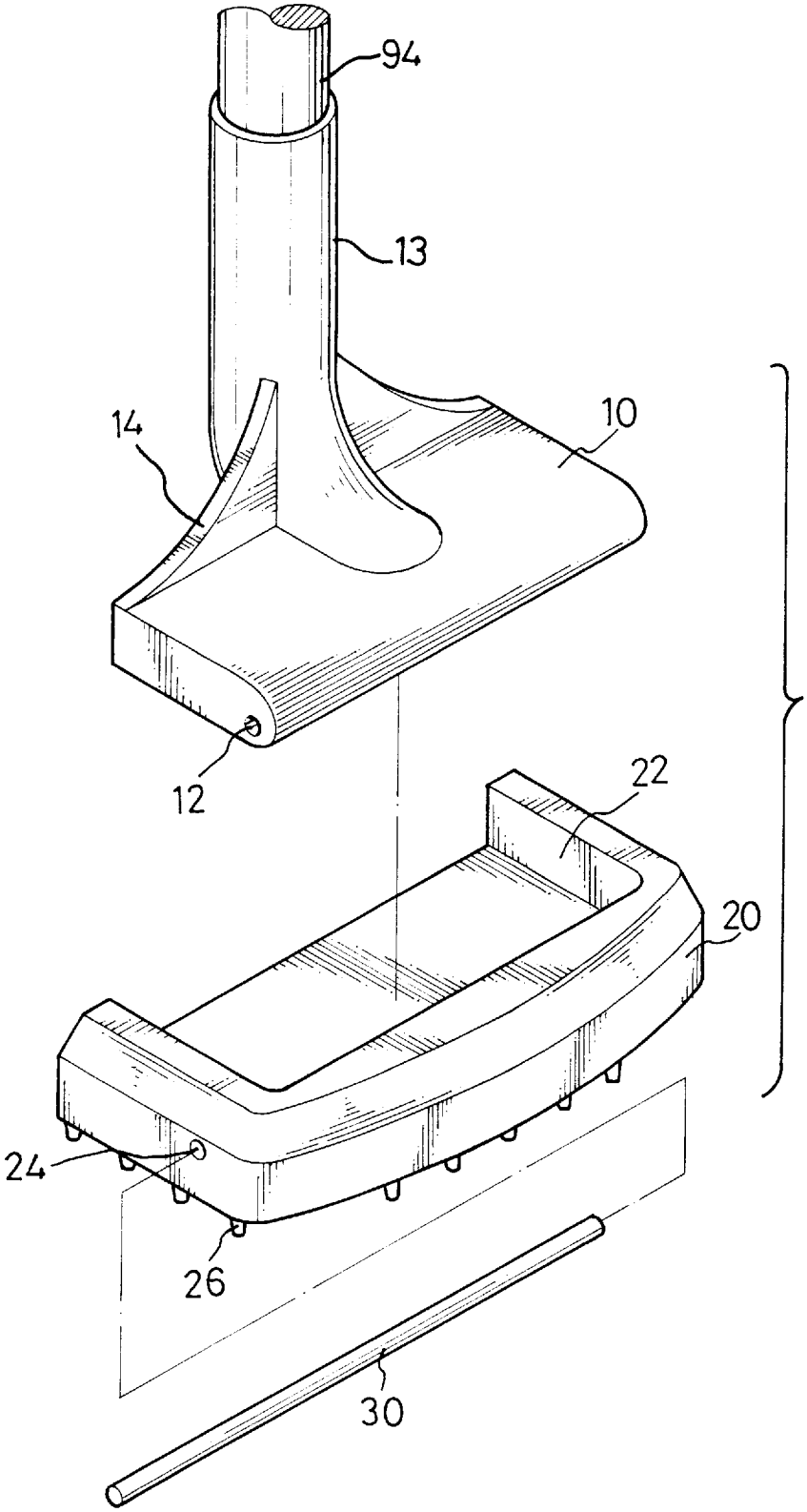
FIG. 2 is an exploded view of the supporting device of the invention.

Referring to FIG. 2, the supporting device includes a supporting plate 10 configured to have a first channel 12 defined therein and a tubular receiver 13 formed integrally with the supporting plate 10 and extending upward therefrom for securely receiving a distal end of the second support 94 therein and a bottom plate 20 having a concavity 22 defined therein. The concavity 22 is configured and sized to mate with the supporting plate 10, so that the supporting plate 10 is able to be snugly received therein. A second channel 24 is defined within the bottom plate 20, to which a pin 30 is able to be inserted therein. Additionally, a pair of webs 14 integrally and opposingly formed with the tubular receiver 13 and the supporting plate 10 are provided to enhance the strength of a connection between the supporting plate 10 and the tubular receiver 13.

Figure 3:
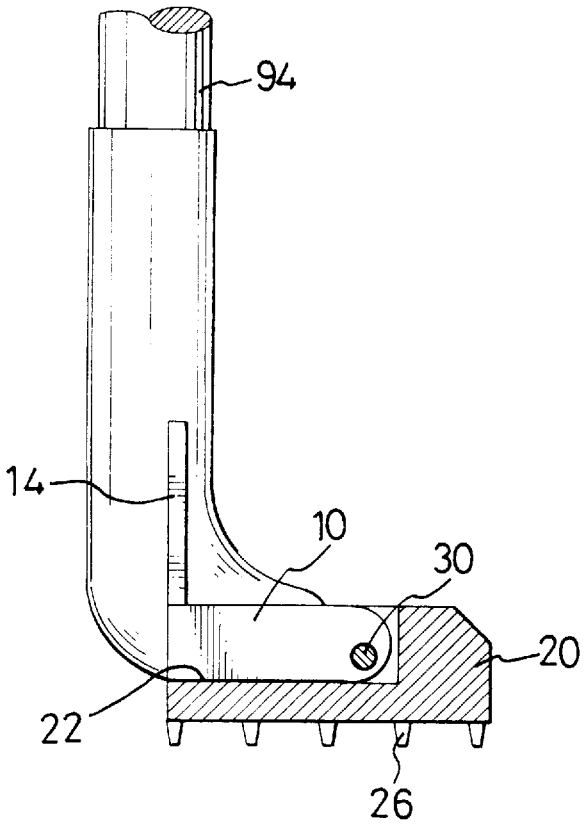
FIGS. 3 and 4 are schematic side views of the supporting device, showing a movement thereof.
Figure 4:
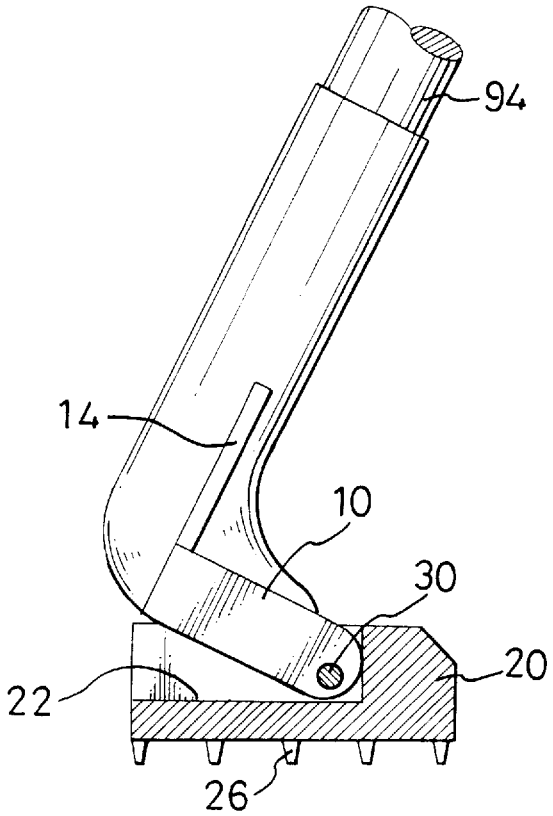

The supporting plate 10 is combined with the bottom plate 20 via the pin 30 respectively inserted into the second channel 24 and the first channel 12, after which, the supporting plate 10 is able to pivot within the concave space 22 of the bottom plate 20, as seen from FIGS. 3 and 4. The distal end of the second support 94 is firstly and securely inserted into the tubular receiver 13 and then the pin 30 is respectively inserted into the second channel 24 and the first channel 12 to pivotally connect the supporting plate 10 and the bottom plate 20 together, such that when a face of the bottom plate 20 contacts the ground, the supporting plate 10 together with the tubular receiver 13 and the second support 94 are able to pivot (as shown in FIG. 4), thereby maintaining the golf bag 90 in a substantially upright position no matter what kind of terrain is found.

Figure 5:
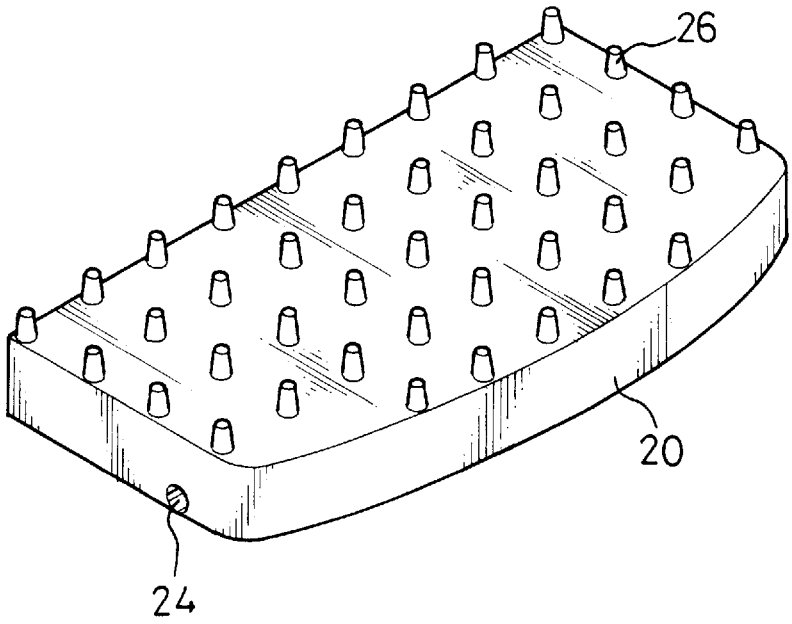
FIG. 5 is a perspective view showing a structure of a bottom plate of the invention.

Referring to FIG. 5, the bottom face of the bottom plate 20 is further provided with a plurality of bosses 26 integrally formed therewith, so that when the bottom face of the bottom plate 20 contacts the ground, a friction therebetween will be increased and hence prevent the golf bag slipping from the upright position.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A supporting device for a golf bag stand comprising:

a supporting plate rigidly connected to the golf bag and configured to have a first channel defined therein and a tubular receiver integrally formed therewith and extending upward therefrom; and a bottom plate pivotally connected to said supporting plate and having a concavity configured to receive said supporting plate therein and a second channel corresponding and communicating with said first channel, to which a pin is able to be inserted therethrough.

2. The supporting device for a golf bag stand as claimed in claim 1, wherein a plurality of bosses are formed integrally with a bottom face of said bottom plate.

3. The supporting device for a golf bag stand as claimed in claim 1, wherein a pair of webs are integrally and opposingly formed on said tubular receiver.

4. A golf bag stand assembly comprising:

a supporting plate adapted to be rigidly connected to the golf bag and having a tubular receiver integrally formed therewith and extending upwardly therefrom; and a bottom plate pivotally connected to said supporting plate and having a concavity configured to receive said supporting plate therein, each of said supporting plate and bottom plate having at least one of a bore formed therein and a pin within said bore.

5. The golf bag stand assembly of claim 4 in which said supporting plate comprises a first laterally extending bore and said bottom plate comprises a second laterally extending bore, said first and second bores being in substantial alignment when said supporting plate is in said concavity, whereby a pin may be placed within said first and second bores.

6. The golf bag stand assembly of claim 4 in which a support member is adapted to be affixed to said golf bag and is received within said tubular receiver.

7. The golf bag stand assembly of claim 4 in which said concavity is formed in the top surface of said bottom plate.

* * * * *